United States Patent [19]

Imai et al.

[11] Patent Number: 4,673,908

[45] Date of Patent: Jun. 16, 1987

[54] POLARIZED RELAY

[75] Inventors: Yoshikiyo Imai, Moriyama; Yuji Yasuoka, Kyoto, both of Japan

[73] Assignee: Omron Tateisi Electronics Co., Kyoto, Japan

[21] Appl. No.: 823,662

[22] Filed: Jan. 29, 1986

Related U.S. Application Data

[63] Continuation-in-part of Ser. No. 603,012, Apr. 23, 1984.

[30] Foreign Application Priority Data

Apr. 22, 1983 [JP] Japan ..... 58-61174

[51] Int. Cl.[4] ..... H01H 51/22

[52] U.S. Cl. ..... 335/79; 335/234

[58] Field of Search ..... 335/78, 79, 80, 81, 335/85, 229, 230, 234

[56] References Cited

U.S. PATENT DOCUMENTS

| | | | |
|---|---|---|---|
| 2,881,365 | 4/1959 | Bernstein | 335/229 |
| 4,064,471 | 12/1977 | Schuessler et al. | 335/78 X |
| 4,142,166 | 2/1979 | Arnoux | 335/81 |
| 4,191,937 | 3/1980 | Koehler et al. | 335/79 X |
| 4,451,808 | 5/1984 | Koehler | 335/81 X |
| 4,563,663 | 1/1986 | Niekawa et al. | 335/78 |

FOREIGN PATENT DOCUMENTS

| | | | |
|---|---|---|---|
| 0074577 | 3/1983 | European Pat. Off. | 335/230 |
| 3320000 | 3/1984 | Fed. Rep. of Germany | 335/78 |
| 2357051 | 1/1978 | France | 335/229 |
| 0003904 | 1/1984 | Japan | 335/230 |

*Primary Examiner*—George Harris

*Attorney, Agent, or Firm*—Schwartz, Jeffery, Schwaab, Mack, Blumenthal & Evans

[57] ABSTRACT

A polarized relay comprises a bar-like core having coil, and a yoke connected to the core and extending in parallel therewith. An armature including a permanent magnet is laterally movably disposed between a pair of upstanding legs formed at a free end of the yoke. Movable contacts are operationally coupled to the armature. The upstanding legs of the yoke have effective areas of magnetic pole. Upon energization of the coil, the armature is moved toward the upstanding leg to close one of the stationary contacts by overcoming the resilient resistance of the movable contact arm. Upon deenergization, the movable contact is held being contact with stationary contact under the magnetic force between the armature and upstanding leg so as to perform a bistable operation.

5 Claims, 5 Drawing Figures

POLARIZED RELAY

CROSS REFERENCE TO RELATED APPLICATION

This is a continuation-in-part of U.S. Ser. No. 603,012, filed Apr. 23, 1984 now pending.

FIELD OF THE INVENTION

The present invention generally relates to a polarized relay of a miniature size adapted to be mounted, for example, on a substrate for a printed circuit.

In particular, the invention concerns an improved polarized relay which has such a structure as comprises an electromagnetic coil assembly, a bar-like iron core inserted in the coil assembly, a movable magnetic block, and movable contact members, wherein the movable contact members are actuated selectively to either one of two switch positions or deenergization of the electromagnetic coil assembly.

DESCRIPTION OF THE RELATED ART

A known polarized relay has for example two U-shaped magnetic cores of magnetic material such as soft iron or the like and an energizable coil wound about the U-shaped magnetic cores. The two U-shaped cores are positioned side by side to form a substantially E-shaped unit. Shims 26 of non-magnetic material are positioned on the ends of the outer legs of the unit in the conventional manner. The energizable coil is positioned around the central legs of the E-shaped unit.

An armature of magnetic material such as soft iron is pivotally mounted on the pivot joint supported by the pivot posts above the central legs of the E-shaped unit. The pivot joint is preferably positioned directly above the inner leg of the U-shaped core which is made longer than the other legs to provide a minimum air gap between this leg and the armature. The pivot joint may advantageously extend through the end of this leg. The armature is pivotally movable to a first position with one end in contact with the outer leg of the U-shaped magnetic core and a second position in which its opposite end is pivoted in contact with the outer leg of the U-shaped core.

In operation, when a direct current is passed through the coil the magnetic cores will be electro-magnetically activated and with a suitable selection of the direction of D.C. current, the magnetic flux will pass through the first and second magnetic circuits in a direction of the dotted arrows so that the magnetic field in the portion of the magnetic circuits common to the first and third circuits, will oppose the field produced by the permanent magnet, at least partially neutralizing the same.

Due to the activation of the second magnetic circuit, and the at least partial neutralization of the portion of the circuit common to the first and third magnetic circuits, with enough current passing through the coil, the armature will be moved to its second position, causing the contact to short-circuit the contacts and separating the contact from the contacts.

As long as the energizing current is applied to the coil, the armature will remain in this position and as soon as the current is shut off, the biasing effect of the permanent magnet, will move the armature back to its first position and maintain the same in that position until further current is supplied to the coil.

However, such prior relay as above described is too bulky and heavy to be mounted on IC chips, setting aside the fact that great check intolerable to IC may be produced.

SUMMARY OF THE INVENTION

Accordingly, an object of the present invention is to provide a polarized relay which is evaded from the difficulties encountered in the relays of prior art.

Another object of the present invention is to provide a polarized relay which can be eliminated in size and is easily mounted on IC chips.

The polarized relay of the present invention comprises a bar-like core wound with an electromagnetic coil, an elongated yoke member having a first end connected to a first end of said bar-like core and extending in parallel with said core, a first upstanding leg and a second upstanding leg both of which are disposed so as to define a space therebetween, a movable magnetic block generally U-shaped in section having a pair of legs magnetically polarized of opposite magnetic polarization, a holder for holding said movable magnetic block, said polarized legs are positioned in air-gaps defined between the upstanding legs and core, movable contacts operatively coupled to said movable magnetic block, at least a stationary contact disposed face to face with said movable contact so that said movable contacts selectively contact with said stationary contact by the operation of said movable magnetic block. Said holder is constructed by a frame holding pole plates and permanent magnet, guide arms laterally extending from the side of the frame, and depending legs provided at the end portions of the guide arms and having slits for engaging with contacting members so as to connect the holder with said connecting members.

By such a construction the polarized relay is produced in a small size, and shock generated in operation of the relay can be eliminated.

The invention is described by referring to attached drawings.

BRIEF DESCRIPTION OF THE DRAWINGS

FIG. 2(*b*) is a side elevational view of the same;

FIG. 2(*c*) is a partially broken end view of the same;

DESCRIPTION OF THE PREFERRED EMBODIMENT

Figure 1:
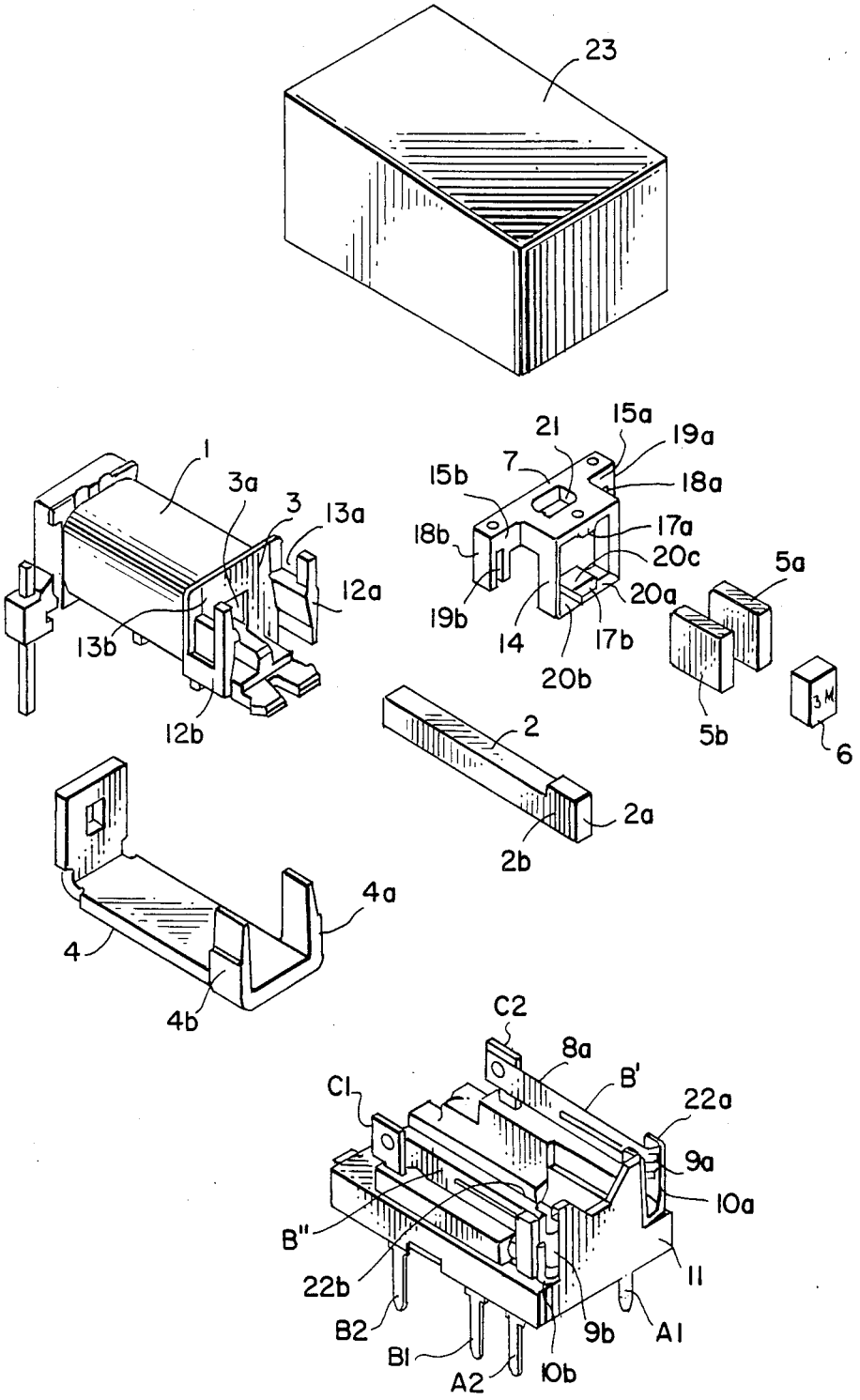
FIG. 1 is an exploded perspective view of an embodiment of a polarized relay according to present invention.
Figure 2A:
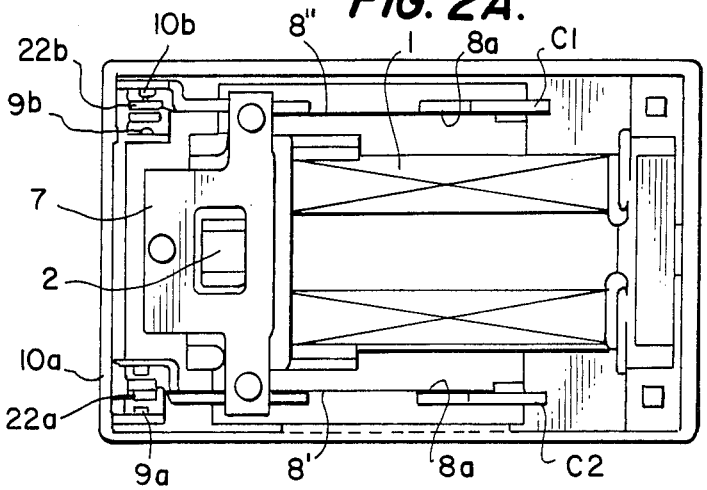
FIG. 2(*a*) is a top plan view showing the polarized relay shown in FIG. 1 in the assembled state.
Figure 2B:
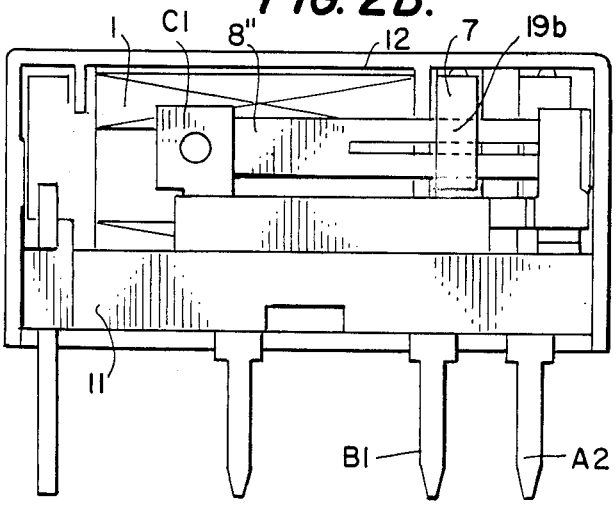
Figure 2C:
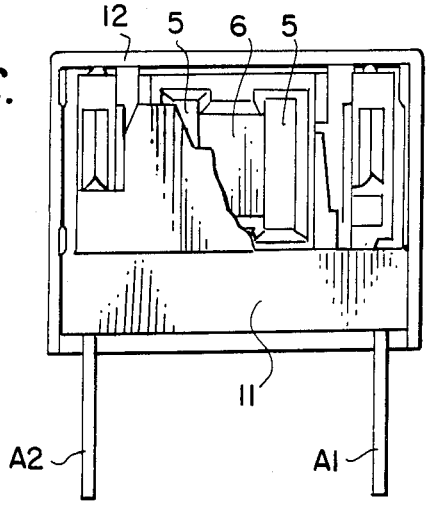

FIG. 1 shows the relay in an exploded perspective view, and FIGS. 2(*a*), 2(*b*) and 2(*c*) show the relay in the assembled state in a top plan view, a side elevational view and an end view, respectively. An electromagnetic coil 1 is wound on a spool 3 having a through-hole 3*a* into which a bar-like iron core 2 is inserted. The spool 3 has, at its first end, a pair of barriers (or insulating wall) 12*a* and 12*b* projecting forwardly from the first end and at both sides thereof. On the top portions of said barriers 12*a* and 12*b*, channels 13*a* and 13*b* are formed respectively. The iron core 2 has an enlarged end portion which serves as stoppers 2*a* and 2*b*. In the state in which the core 2 is inserted completely in the through-hole or bore 3*a* of the spool 3, the end portion serving as the stoppers 2*a* and 2*b* projects outwardly from the end of the spool 3. A yoke 4 is disposed below the electromagnetic coil assembly 1 so as to form a magnetic circuit in cooperation with the iron core 2. The yoke 4 is of a substantially U-shaped configuration and has a pair of bifurcated upstanding legs 4*a* and 4*b* formed integrally at the free end. In the assembled state, the end portion (2*a*, 2*b*) of the core 2 is disposed substantially at a mid point between the upstanding legs 4*a* and 4*b* of the yoke 4. A movable magnetic block or armature is constructed generally U-shaped in section having a pair of legs magnetically polarized in opposite polarization to each other or otherwise, is constituted by a permanent magnet 6 which is fixedly sandwiched between pole pieces or plates 5*a* and 5*b* and held together by means of a frame-like holder denoted by a numeral 7 as shown in FIG. 1. The holder comprises a frame 14 rectangularly formed, guide arms 15*a* and 15*b* laterally extending from the sides of the frame 14, depending legs 18*a* and 18*b* provided at the end portions of said guide arms 15*a* and 15*b* respectively and extending downwardly. On the depending legs 18*a* and 18*b*, slits 19*a* and 19*b* opening downwardly are formed respectively. At the laterally central portions of the inside faces of top and bottom walls of the frame 14, projection 17*a* and 17*b* are provided, so that vertically narrow space 20*c* and vertically wide spaces 20*a* and 20*b* disposed both sides of said vertically narrow space 20*c* are formed inside the frame 14. The pole plates 5*a* and 5*b* are inserted in the vertically wide spaces 20*a* and 20*b* respectively and held therein, on the other hand, the permanent magnet 6 is held between the pole plates 5*a* and 5*b* and vertically supported by the projections 17*a* and 17*b* in the frame 14 of the holder 7. Further, a through-hole 21 is opened on the top wall of the frame 14 so that the contacting condition between the core 2 and pole plates 5*a* and 5*b* is visually checked. The holder 7 is operatively connected with movable contact members 8′ and 8″ having at the free ends movable contacts 22*a* and 22*b* in the manner that said movable contact members 8′ and 8″ are inserted in the guide grooves or slits 19*a* and 19*b* of the holder 7.

In the assembled state of the polarized relay, the guide arms of the holder 7 are laterally slidably set in or engaged with channels 13*a* and 13*b* formed on the barriers 12*a* and 12*b* provided at the first end of the spool 3. Said guide arms 15*a* and 15*b* are supported in the channels 13*a* and 13*b* with being prevented from moving forward or backward. The movable magnetic block or armature held by the holder 7 is disposed laterally movably between the pair of upstanding legs 4*a* and 4*b* of the yoke 4, wherein the enlarged end portion serving as the stoppers 2*a* and 2*b* of the core 2 is positioned in a space defined between the pole plates 5*a* and 5*b* in opposition to the permanent megnet 6. There are thus formed air gaps between the core 2 and the pole plates (5*a*, 5*b*) on one hand and between the upstanding legs (4*a*, 4*b*) of the yoke 4 and the pole plates (5*a*, 5*b*), respectively. The stopper faces 2*a* and 2*b* serve to limit the movement of the movable magnetic block constituted by the permanent megnet 6 and the pole plates 5*a* and 5*b* held together by the holder 7. Further, the barriers 12*a* and 12*b* are set (or positioned) between the movable contact members (or arms) 8′ and 8″ and the upstanding legs 4*a* and 4*b* of the yoke 4 respectively, so that said barriers 12*a* and 12*b* separate the contact members 8′ and 8″ from the upstanding legs 4*a* and 4*b* for obtaining electrical insulation therebetween. The movable contact 22*a* is interposed between stationary contacts 9*a* and 10*a* disposed in opposition to each other with said movable contact 22*a*. On the other hand, the movable contact 22*b* is interposed between stationary contacts 9*b* and 10*b* disposed in opposition to each other with said movable contact 22*b*. In the stationary contacts 9*a*, 9*b* or 10*a*, 10*b*, one of them can be deleted for constituting a contacting mechanism including one movable contact and one stationary contact.

The component 1 to 10 mentioned above are mounted on a base plate 11 which carries connector pins A1, A2, B1, B2, C1 and C2 depending downwardly. The relay thus assembled is protected by a cover case 23. This cover case 23 prevents the holder 7 from moving upward.

In operation, when the electromagnetic coil 1 is electrically energized in one direction, the iron core 2 is magnetized in a corresponding direction, as a result of which there are formed megnetic poles in the upstanding legs 4*a* and 4*b* of the yoke 4, respectively. In this connection, it is assumed that the permanent magnet 6 is magnetized as indicated by simbols S and N in FIG. 1 and that N-pole makes appearance in the upstanding leg 4*b* of the yoke 4 through the energization mentioned above. On the assumption, the holder 7 holding the movable magnetic block is moved toward the upstanding leg 4*b* under magnetic attraction acting between the leg 4*b* and the permanent magnet 6 as well as under repulsing force acting between the magnet 6 and the upstanding leg 4*a* of the yoke 4. When the force acting on the holder 7 and hence the movable magnetic block or armature overcomes the spring force or resilient resistance of the movable contact arms 8′ and 8″, the latter are moved toward stationary contacts 10*a* and 10*b* respectively, resulting in that the movable contacts 22*a* and 22*b* of the movable contact members 8′ and 8″ are closed to the stationary contacts 10*a* and 10*b*. This is because the movable contact members 8′ and 8″ are operationally coupled to the holder 7 at the depending legs 18*a* and 18*b* respectively, as described above. On the other hand, when the direction of the current flowing through the electromagnetic coil 1 is changed over, the series of operations described above take place in the reverse direction, whereby the movable contacts 22*a* and 22*b* carried by the movable contact members 8′ and 8″ are detached from the stationary contacts 10*a* and 10*b* to be closed to other stationary contacts 9*a* and 9*b* respectively. The relay designed to perform the above operation is generally referred to as the latching or bistable type relay.

Figure 3:
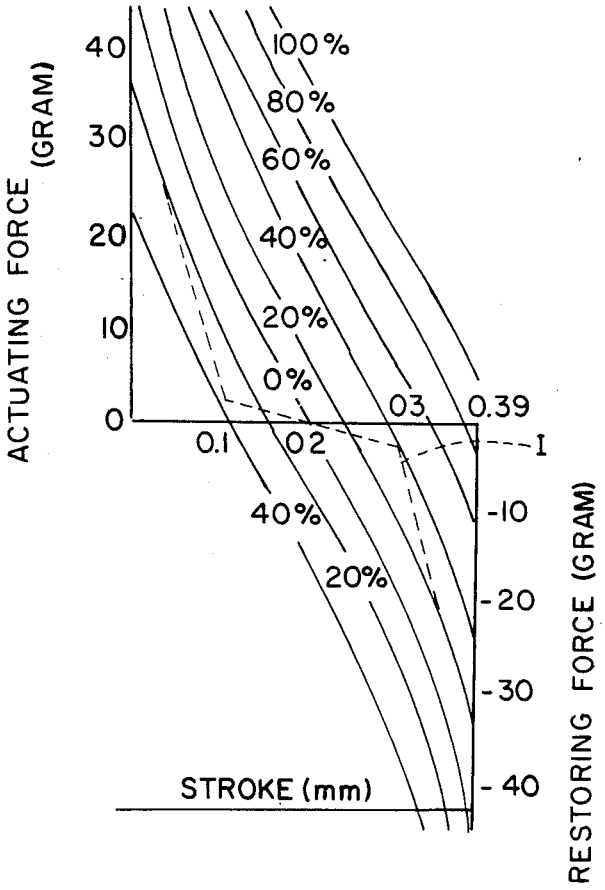
FIG. 3 is a view for graphically illustrating the operation characteristics of the polarized relay shown in FIGS. 1 through 2(*c*).

FIG. 3 of the accompanying drawings graphically illustrates operation characteristics of such bistable relay. In the figure, a broken line curve I represents intrinsic resilient resistance of the movable contact members 8′ and 8″ which has to be overcome by the electromagnetic force in the switching operation of the relay. This curve I may be referred to as the load characteristic curve. In FIG. 3, the stroke of the movable contact members 8′ and 8″ performed upon switching operation of the relay is taken along the abscissa. The electromagnetic force (actuating force) required to move the movable contacts 22*a* and 22*b* to one of the stationary contacts 9*a*, 9*b* or 10*a*, 10*b*, e.g. the stationary contacts 10*a* and 10*b*, is taken along the lefthand ordinate, while the electromagnetic force (restoring force) required for the restoration of the movable contacts 22*a* and 22*b* to the other stationary contacts 9*a* and 9*b* is taken along the righthand ordinate. Intersection of the load curve I with the abscissa at a point 0.2 means that the movable contact (for example, movable contact 22*a*) carried by the movable contact member 8′ is located at the mid position between the stationary contacts 9*a* and 10*a*. Solid curves represent stepwise the levels of the excitation current of the magnetic coil 1. As will be seen from FIG. 3, so long as the movable contacts 22*a* and 22*b* are in the state closed to the stationary contact, this state is maintained even in the deenergized state of the magnetic coil (excitation current of 0%), because of the magnetic force of the permanent magnet 6. In order to move the movable contacts 22*a* and 22*b* away from the stationary contacts 9*a*, 9*b* Or 10*a*, 10*b*, the excitation current supplied to the coil in the corresponding direction must rise up to the level of more than 20% of the rated value (100%). In this way, in the case of the bistable relay, energization of the coil is required every time the movable contacts are changed over from one to the other stationary contacts.

As will be apparent from the foregoing, a portable and quiet operational polarized relay can be produced by assemblin core, yoke, movable magnetic block and elongated contact members coupled to said megnetic block and having movable contact and stationary contact being face to face with said movable contact whereby the manufacturing process of the polarized relay can be much facilitated and simplified.

Although the invention has been described in connection with the illustrated embodiment, modifications and variations thereof will readily occur to those skilled in the art without departing from the spirit and scope of the invention which is therefore never restricted to the disclosed embodiment.

What is claimed is:

1. A polarized relay comprising:

a bar-like core wound with an electromagnetic coil;

a yoke having a first end connected to a first end of said bar-like core and extending substantially in parallel with said core, a first upstanding leg and a second upstanding leg, both of which are disposed so as to define a space therebetween, wherein a second end of said core is positioned substantially at a mid point of said space;

a movable magnetic block generally U-shaped in section having a pair of pole plates of opposite magnetic polarization;

a holder for holding said movable magnetic block;

wherein, one of said pole plates is positioned in air-gap defined between said first upstanding leg and said core, and the other of said pole plates is positioned in air-gap defined between said second upstanding leg and said core;

movable contacts supported by movable contact means operatively coupled to said movable magnetic block;

stationary contacts provided at least one per one movable contact and disposed face to face with said movable contacts respectively so that said movable contacts selectively contact with said stationary contacts by the operation of said movable magnetic block;

wherein said holder is constructed by a frame holding pole plates and permanent magnet, guide arms laterally slidably mounted on the spool, and depending legs having slits in which movable contact members are inserted and operatively connect with said holder.

2. A polarized relay according to claim 1 wherein; a through-hole is opened on the top wall of the frame through which the contacting condition between the core and the movable magnetic block is visually checked.

3. A polarized relay according to claim 1 wherein; in the frame vertically narrow space and vertically wide spaces disposed both sides of said vertically narrow space are defined, and pole plates are inserted in the vertically wide spaces respectively and held therein, on the other hand the permanent magnet is held between the pole plates vertically supported in the vertically narrow space.

4. A polarized relay according to claim 1 wherein; channels are provided on a first end of the spool, the guide arms of the holder are set in the channels and are prevented from moving forward and backward and held upwardly by a cover case.

5. A polarized relay according to claim 1 wherein; barriers are projecting forwardly from the first end of the spool, said berriers are set between the contact members and the upstanding legs for obtaining electrically insulation therebetween.

* * * * *